United States Patent [19]

Scofield

[11] 3,999,041

[45] Dec. 21, 1976

[54] SUMMING CALCULATOR TO ASSIST ANALYSIS OF PAST PERFORMANCE

[76] Inventor: Joseph Scofield, P.O. Box 5469, Big Bear Lake, Calif. 92315

[22] Filed: Jan. 8, 1976

[21] Appl. No.: 647,592

[52] U.S. Cl. ..... 235/61 G; 235/70 A; 235/89 R

[51] Int. Cl.[2] ..... G06C 3/00; G06G 1/02

[58] Field of Search ..... 235/61 E, 61 G, 70 R, 235/70 A, 89 R, 89 A

[56] References Cited

UNITED STATES PATENTS

| | | | |
|---|---|---|---|
| 1,686,843 | 10/1928 | Burke | 235/89 R X |
| 2,283,799 | 5/1942 | Favalora | 235/61 G UX |
| 2,520,208 | 8/1950 | Green | 235/89 R |
| 2,532,619 | 12/1950 | Heerich | 235/89 R |
| 2,794,597 | 6/1957 | Mafoof | 235/61 G UX |
| 3,053,447 | 9/1962 | Azar | 235/70 A |
| 3,232,531 | 2/1966 | Hodge, Jr. | 235/61 G UX |
| 3,272,431 | 9/1966 | Dablo | 235/89 R X |
| 3,701,471 | 10/1972 | Kurland | 235/61 G X |
| 3,714,399 | 1/1973 | Cataland | 235/61 G X |
| 3,831,839 | 8/1974 | Boardman | 235/61 G X |

*Primary Examiner*—Stanley J. Witkowski

*Attorney, Agent, or Firm*—Wm. Jacquet Gribble

[57] ABSTRACT

A calculating device for use in conjunction with past performance data conventionally compiled and published on each active thoroughbred horse performing on U.S. racetracks, has three cooperating transparent slides each indexed visibly in terms of racehorse racing time and in speed ratings. The first, or innermost, slide is compound, with time and rating scales and time and distance columns on its obverse face, and assigned weight, age, post position, calendar, track condition and class data expressed in time difference increments on its reverse face. A second slide surrounds the first, and carries a speed rating index extending along the direction of slide motion. An outer slide movable relative to both others has transverse index lines based on seconds of time as expressed on the innermost slide and a table of conventional time performances for various segments of various races. The calculator accepts data taken from the racing form past performance chart and accurately and rapidly translates the compiled data into comparative ratings of animals entered against one another in a given future race over a given distance.

6 Claims, 13 Drawing Figures

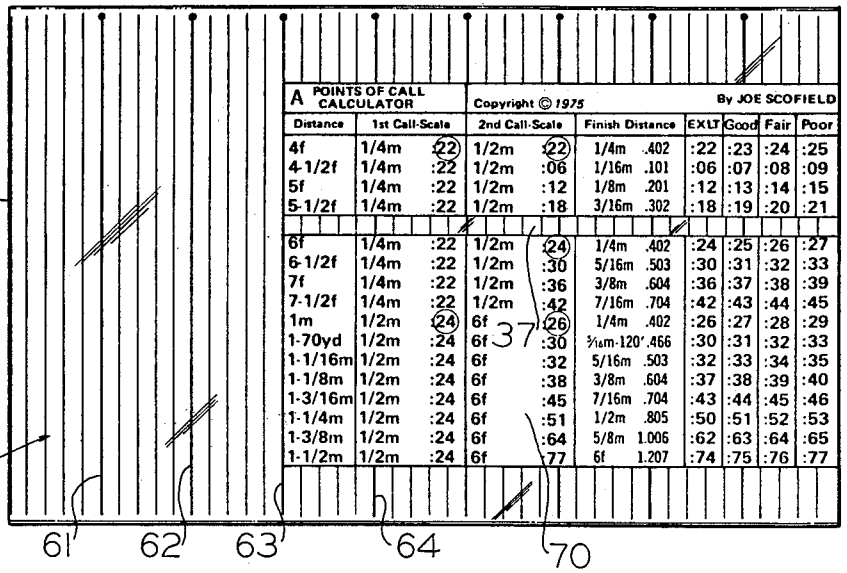

A POINTS OF CALL CALCULATOR

Copyright © 1975 By JOE SCOFIELD

| Distance | 1st Call-Scale | 2nd Call-Scale | Finish Distance | EXLT | Good | Fair | Poor |
|---|---|---|---|---|---|---|---|
| 4f | 1/4m (22) | 1/2m (22) | 1/4m .402 | :22 | :23 | :24 | :25 |
| 4-1/2f | 1/4m :22 | 1/2m :06 | 1/16m .101 | :06 | :07 | :08 | :09 |
| 5f | 1/4m :22 | 1/2m :12 | 1/8m .201 | :12 | :13 | :14 | :15 |
| 5-1/2f | 1/4m :22 | 1/2m :18 | 3/16m .302 | :18 | :19 | :20 | :21 |
| 6f | 1/4m :22 | 1/2m (24) | 1/4m .402 | :24 | :25 | :26 | :27 |
| 6-1/2f | 1/4m :22 | 1/2m :30 | 5/16m .503 | :30 | :31 | :32 | :33 |
| 7f | 1/4m :22 | 1/2m :36 | 3/8m .604 | :36 | :37 | :38 | :39 |
| 7-1/2f | 1/4m :22 | 1/2m :42 | 7/16m .704 | :42 | :43 | :44 | :45 |
| 1m | 1/2m (24) | 6f (26) | 1/4m .402 | :26 | :27 | :28 | :29 |
| 1-70yd | 1/2m :24 | 6f :30 | ⅜um-120' .466 | :30 | :31 | :32 | :33 |
| 1-1/16m | 1/2m :24 | 6f :32 | 5/16m .503 | :32 | :33 | :34 | :35 |
| 1-1/8m | 1/2m :24 | 6f :38 | 3/8m .604 | :37 | :38 | :39 | :40 |
| 1-3/16m | 1/2m :24 | 6f :45 | 7/16m .704 | :43 | :44 | :45 | :46 |
| 1-1/4m | 1/2m :24 | 6f :51 | 1/2m .805 | :50 | :51 | :52 | :53 |
| 1-3/8m | 1/2m :24 | 6f :64 | 5/8m 1.006 | :62 | :63 | :64 | :65 |
| 1-1/2m | 1/2m :24 | 6f :77 | 6f 1.207 | :74 | :75 | :76 | :77 |

71 14 61 62 63 64 37 70

FIG. 8.

Now Pending 115 B. f (1973), by Petrone—Tale Sow, by Gun Bow.
Br., Mr. & Mrs. W. P. Klussman (Calif.). 1975 5 2 0 0 $10,450
Owner, Pender & Stathatos. Trainer, D. Mortensen.

| | | |

SUMMING CALCULATOR TO ASSIST ANALYSIS OF PAST PERFORMANCE

BACKGROUND OF THE INVENTION

The invention relates to slide rule calculators and more particularly to calculators for accurately and quickly performing the calculations normally done by longhand and based upon the data published nationally by racing publications as "past performance charts". Such charts list the performances for each horse entered in a particular race, in terms of a horse's position in the race at various stages related to the leading horse at the stage, the time at that stage or point of call for the leading horse, and the winning time of the race and particular horse's finish position. The horse's post position, weight carried, track and track condition, as well as the race distance and other information are all printed in a standard tabulation for each projected race, thus giving the past performance history of each entered animal in the race. Such publications as *Daily Racing FORM* and *NEW York Daily Telegraph* are widely known for such charts, which are used by professional racing enthusiasts and bettors to calculate the ratings of each horse in a given race to guide them in selecting a probable winner.

The process of winner selection is involved, and many factors must be considered, as will be apparent from the following discussion of the use of the inventive calculator. However, it is not the purpose of this application to teach others to "handicap" horses, but to disclose and claim the inventive calculator by which such calculations may be more easily and accurately done than by previous long hand methods or conventional calculators now in use.

My calculator has as an objective the aiding of knowledgable handicappers to calculate from known data the comparative ratings of competing horses quickly and accurately, without the need to learn new methods or skills. Another objective is to provide expert analysts of horseracing with a hand-held tool usable at the racetrack on the day of the race. A further objective is to provide a calculator which not only adds and subtracts known data to derive a rating from past performance, but which also provides on the calculator data of a standard nature not given in the past performance charts by which the derived rating may be modified for greater accuracy. Another objective is to provide a calculator that gives rating figures in different terms, such as time, track record time, speed rating and an arbitrary rating scale related to the speed rating given in the charts.

These objectives are accomplished by a calculator having three relatively movable parts each scaled and indexed in terms of time and distance, and having tubular date in addition to the time and distance scales.

SUMMARY OF THE INVENTION

The invention contemplates a calculator for use with known time and distance facts that comprises a composite or compound slide, a inner slide and an outer slide, at least the outer and the inner slides being transparent. An obverse face of the composite slide has a longitudinal time scale, preferably in parts of seconds, and a longitudinal pace or rating scale. The same face also carries longitudinally spaced columns of distances and times, each time being for a stated race distance. The column times increase for a given distance by columns longitudinally and oppositely to the numerical increase of the pace scale. In a preferred embodiment the composite slide is compound, a reverse face having standard data bits which may affect performance stated in time or horse lengths which are translated into time by standard formulae.

The inner slide carries a central speed rating index that extends longitudinally of the slide. The spacing of the speed units corresponds to the spacing of the time and pace units on the composite slide. The outer slide surrounds the other two and has transverse index lines spaced longitudinally in accord with the time scale on the composite slide. The speed rating is a standard factor of the charts. The spacing of the speed rating units matches the spacing of the time and pace units an the composite slide. A table of distances and times on the outer slide aligns time increments with race increments of distance.

The calculator is preferably made of transparent plastic with indices and data not stamped, engraved or imprinted on the surfaces. The inner and outer slides are preferably tubular and mutually slidable. Both move with respect to the composite slide. The calculator may be manufactured by conventional methods and is accurate and swift in the hands of these sophisticated handicappers for whom it is intended. These and other advantages of the invention are apparent from the detailed description and drawing which follow.

BRIEF DESCRIPTION OF THE DRAWING

FIG. 6 a past performance chart as actually published;

FIG. 7 is an elevational view of the obverse of the inner slide alone;

FIG. 8 is an elevational view of the obverse of the outer slide alone;

In the various views like parts are designated by like numbers.

DESCRIPTION OF THE PREFERRED EMBODIMENTS

Figure 1:
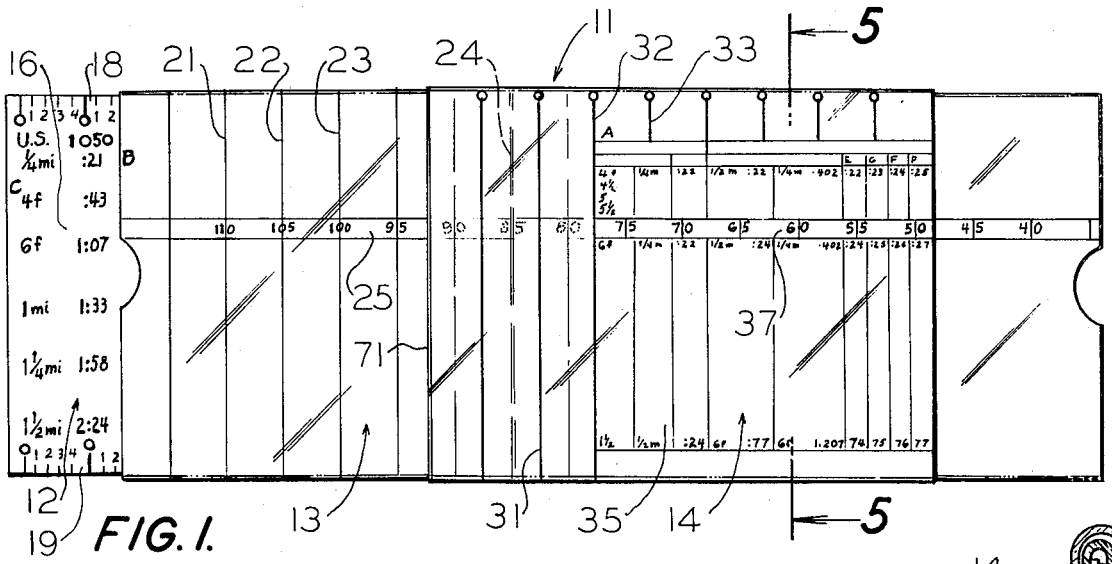
FIG. 1 is an elevational view of the calculator with the slides thereof displaced with respect to one another.

In FIGS. 1 – 4 a calculator 11 has a compound slide 12, an inner slide 13 and an outer slide 14. Slides 12 and 13 are the same length, while outer slide 14 is slightly over half the length of the other slides. Compound slide 12 has an obverse face 16 and a reverse face 17. The obverse face has time scales 18 and 19 at the long edges of the slide. The scales increase left to right and each increment between zeros represents a second. Each second is divided into fifths of a second.

A column of distances increasing from top to bottom in FIG. 1 is at the left edge of the slide 12. Visible also at the left of the slide is the high number 1050 of a Pace index. In vertical line with the Pace number is a column of times, longitudinally aligned with the distances in the marginal column. Note that the Pace number is in vertical alignment with an even second index on the time scale.

The inner slide 13 has transverse or vertical index lines 21, 22, 23 which are spaced apart a distance equal to the space of a second on the time scale of slide 12. A longitudinal index line 25 extends across the inner slide, decreasing in indicated magnitude from 110 on the left in FIG. 1 to 40 on the right. Each index line indicates a "Speed Rating" from 110 to 40, a rating that is charted in the past performance publications.

A third or outer slide 14 has transverse index lines like lines 31, 32, 33 which are interrupted by a data table 35. The table itself is interrupted by a transparent band 37 through which the "Speed Rating" numbers may at all times be read.

Figure 2:
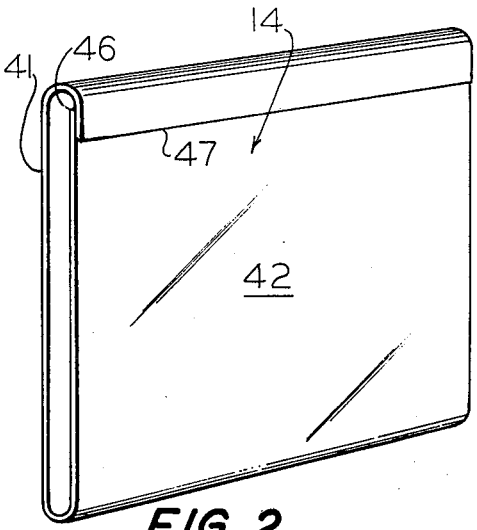
FIGS. 2, 3, and 4 are oblique reverse views of the outer, inner and compound slides, respectively.

As can be seen from FIG. 2, outer slide 14 is preferably an envelope of transparent plastic having an obverse side 41 on which the index lines 31, 32, 33 and the data table 35 are printed or engraved. The reverse side 42 is blank, but preferably also transparent. The edges 46, 47 of the slide over-lap and may be adhered adhesively or by heat to form the envelope in which inner slide 13 reciprocates. Slide 13 may also be an envelope with obverse and reverse faces 48, 49, respectively, with the Speed Rating index 25 the obverse face. Longitudinal edges 51, 52 of the inner slide 13 are butted to form a smooth reverse face. The edges may be joined adhesively, by solvent welding or heat sealing.

Figure 4:
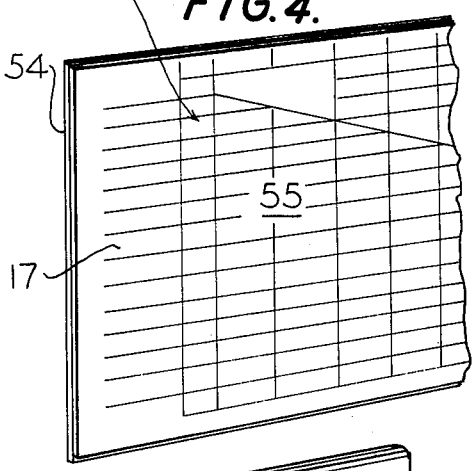
Figure 3:
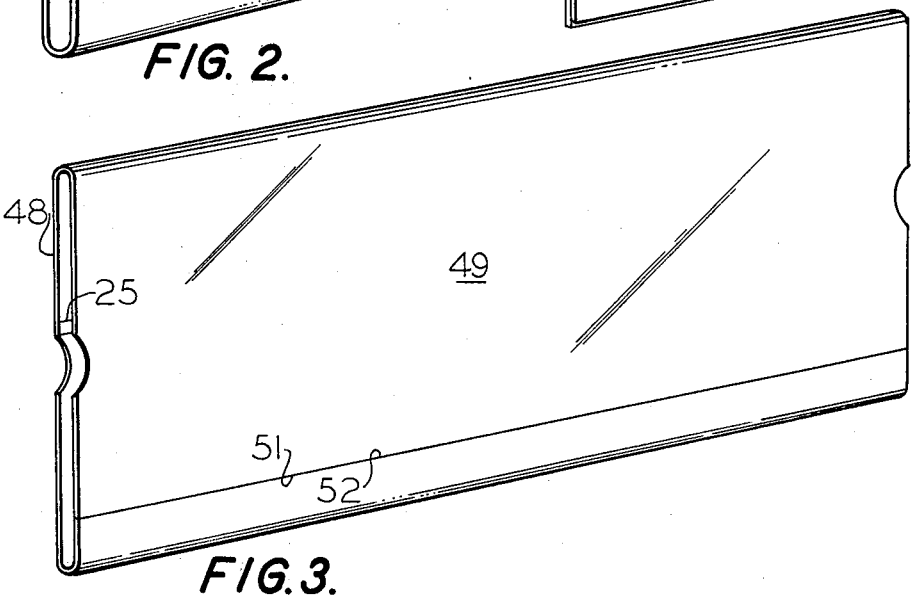
Figure 5:
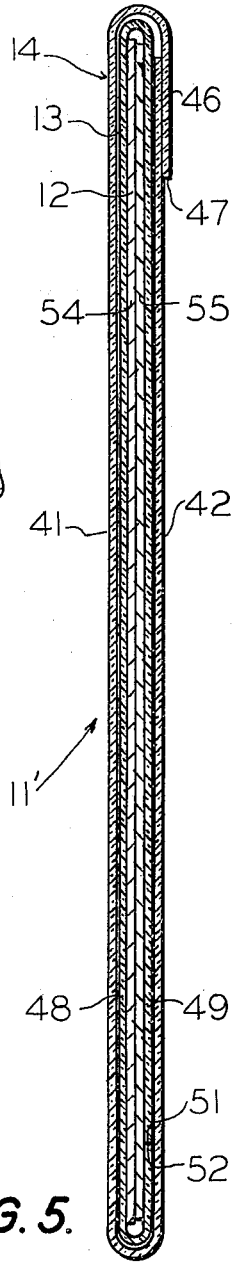
FIG. 5 is a sectional elevation taken along line 5 – 5 of FIG. 1, showing an alternate embodiment.

The sectional elevation of FIG. 5 shows the slides assembled. In FIGS. 2 – 5 thicknesses and clearances are exaggerated.

In FIG. 4 slide 12 is shown as comprised of a first laminate 54 on which the time scales and distance and time columns are fixed, and a second laminate 55 upon which is located correlative data that may be in addition to that data given in the published past performance charts. Such data appears in FIG. 10 to which reference is made later in the application.

While the second laminate may be combined with the first to define a compound slide like slide 12, an alternate embodiment may combine the second laminate with the inner slide, adhereing the laminate to the reverse side 49 thereof, preferably inside the envelope so that data characters are protected from abrasive wear. The data may also be printed on the inner face of the reverse side of the inner slide before the slide is made tubular and no second laminate would be needed. Since the data of the second laminate need not be physically related to the other slides, its positioning is flexible, being dictated by ease of access and visibility while the calculator is in use.

The embodiment of calculator 11' in FIG. 5, for instance illustrates the second laminate adhered to the inside of the inner slide 13 such that the second laminate moves with the inner slide, not the composite slide. The calculator of FIG. 5 is otherwise the same as the embodiment of FIG. 1. The embodiments described operate easily by sliding with respect to each other each of the slides so that the various scales and indices may be positioned properly for summing (adding or subtracting) the information on a given animal from the past performance chart to obtain a rating for the animal either in terms of time performance, a speed rating comparing its time to track records for the distance involved, or a "pace" number which sums up time and other factors.

The information derives from a past performance chart such as the chart of FIG. 6, wherein a horse "Now Pending", entered in the eighth race at Santa Anita track at a mile and a sixteenth for 2 year old fillies, has her past races reported. As mentioned before, the format of the chart is conventional, and is given in the news sheet for each horse in each race, grouped by race. In addition to ownership and antecedents, all previous races are listed in reverse order, the last run race being given first. Date, track and distance of the race are given from left to right. Fractional times follow, the first being the leader's time at the "first call" point, the second at the "second call" point and the third time being the finish time of the winner. Track condition is printed next, the Oct. 18, 1975 race being run on a fast track (ft). Closing odds (3 – 1), weight carried (115) are followed by "Now Pending's" position in the field at the first call (2nd, 1½ lengths back), the second call (the same), stretch (1st by 2 lengths) and finish (1st by 2 lengths). The jockey is then noted, with post position at the start, type of race, and then the Speed Rating (76) related to winning time versus track record for the distance.

The first two finishers are then named, the "F" in a circle denoting a race for fillies only, and the "115" the weight the winner ("Now Pending") carried. The previous races of the horse are listed in the same fashion below the line just traversed, so that a handicapper has before him the entire race history of the animal.

Since "Now Pending" is a 2 year old, the chart is short. Older horses are reported on for the last ten races run. Recent workouts are reported, if known, on the bottom line.

The expert handicapper considers many factors in addition to past performance data, but this data is the most important in comparing competing horses. Other information adds or subtracts from the basic rating of an animal calculated from past performance.

FIGS. 7 – 13 show a preferred embodiment of the invention wherein the compound slide 12' (FIGS. 9 and 10) comprises two laminates 54, 55 fixed together. FIG. 7 shows an inner slide 13 marked with a "B" and having a "Speed Rating" index strip 25 extending longitudinally. The index strip is divided by fives between 105 and 40, descending numerically from left to right. Transverse index lines like the lines 21, 22, 23 extend the width of the slide and coincide longitudinally with the fives divisions. The strip 25 may be further divided to indicate single units between index lines.

At Speed Rating "85" an index line 24 is thickened or colored to distinguish it visually from other lines. This Speed Rating value has been arbitrarily selected on the basis of experience as a median point from which performances are compared, the words "SUB" and "ADD" on either side of the "85" line being direction indicators for calculator slide motion to sum the data.

Figure 9:
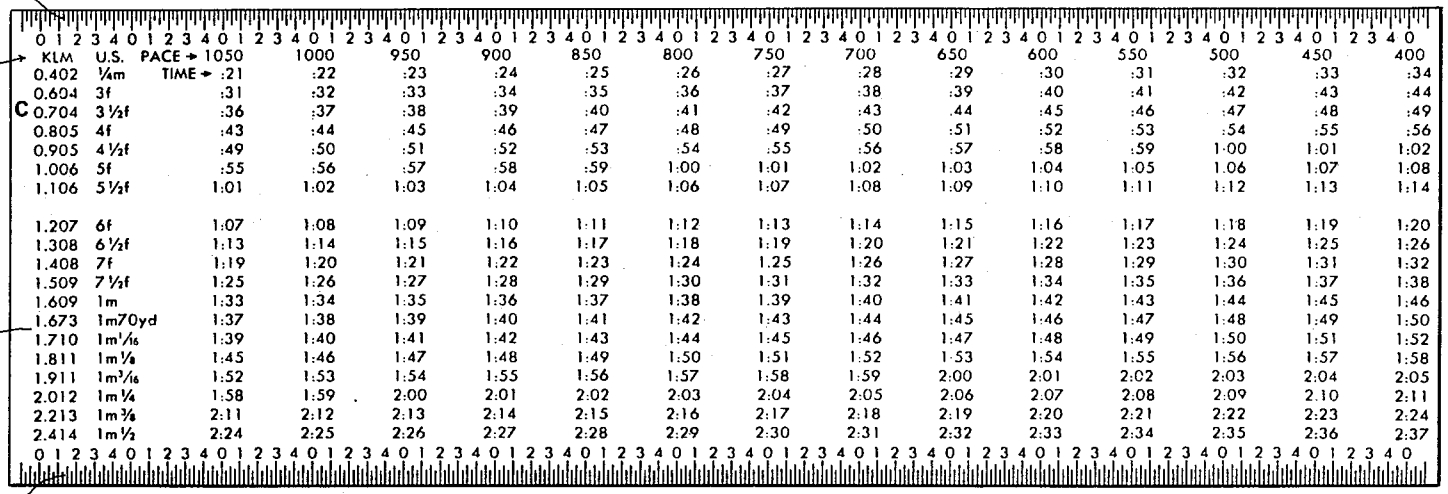
FIG. 9 is an elevational view of the obverse face of the compound slide.
Figure 10:
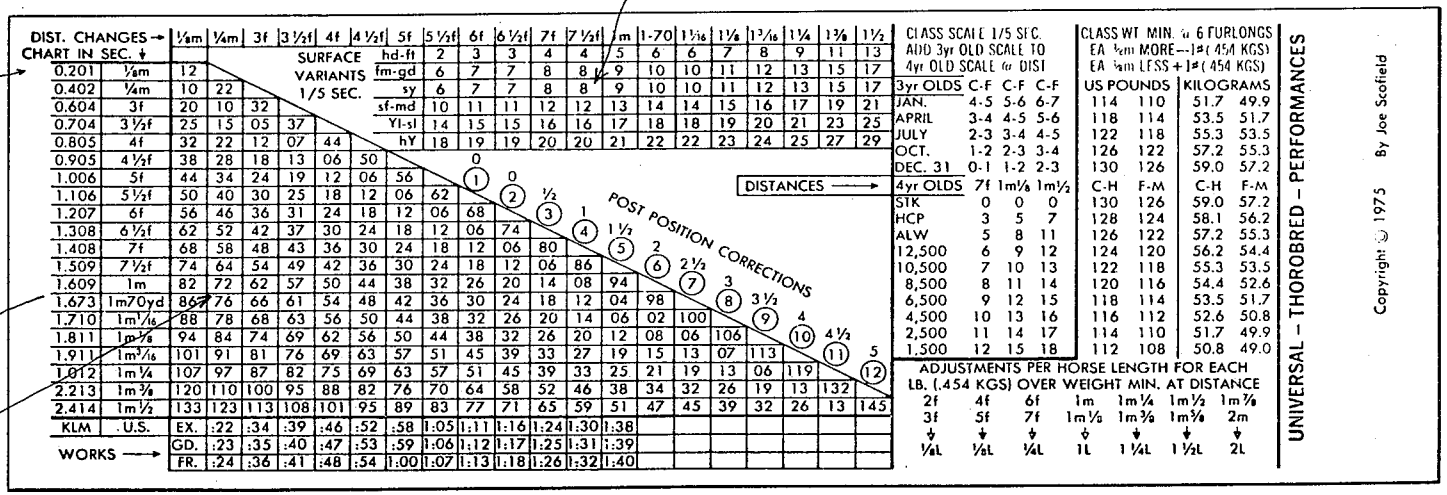
FIG. 10 is an elevational view of the reverse face of the compound slide.

FIG. 8 shows outer slide 14 with index lines like 61, 62, 63 64, extending transversely of the slide and spaced longitudinally to coincide with the spacing of index lines 21– 24 of slide 13. Both slides 13 and 14 are preferably of transparent plastic in envelope shape, slide 13 fitting slidably into slide 14 and about slide 12' as in the previously described embodiment. The compound slide 12′ is shown in FIGS. 9 and 10.

A time and distance table 70 intervenes in the transverse span of the index lines like line 64 of slide 14. The table is a "points of call" calculator with columns of data, being itself interrupted by longitudinal clear area 37 through which index strip 25 of slide 13 is visible during calculations. Table 70 is marked "A" being the outside slide, to simplify instruction as to use. Slide 13 is marked "B" and slide 12 is marked "C", while the laminate 55 is unmarked except for its division titles. These components are in this application referred to by reference numerals, not by the alphabet letters.

The leftward column of table 70 in all the Figures is headed "Distance" and denotes the distance of the race to be calculated. The next column, the "1st Call Scale", sets forth a time span which is related to the distance increment between the "first call " point and the "second call" point. In the short races there is no second call, so a reference figure is given, as is true for the short race in the "second call" scale, where the distance is related to a time increment for the race from the point of second call to the finish. For instance, FIG. 6 shows the first call for the mile race to be at the half mile, the time of the lead horse being called at 45 3/5 seconds. The second call is at six furlongs (¾ mile), and the lead horse's time was 1:11 2/5. Subtraction shows the time difference between the first call and the second call to be 71 2/5 seconds minus 45 3/5 seconds or 25 4/5 seconds, commonly referred to as "early pace" time. In table 70 the reference time on the first call scale for a mile race is 24 seconds.

The "late pace" time is determined between the second call and the finish line. FIG. 6 shows the finish time as 1:38 3/5. The late pace in seconds is thus 98 3/5 seconds minus 71 2/5 seconds or 27 1/5 seconds. This figure is only for the lead times given. The handicapper must modify these times for a particular horse with regard to the horse's position at the points of call and the finish line, to achieve early and late pace times for each horse in a prospective race.

In the case of "Now Pending", and considering a general rule is that one length is traversed in one-fifth second in the average race, the filly's first call time was 45 3/5 seconds, plus distance behind of 1½ lengths or about 2/5 seconds, equalling 46 seconds flat. At the second call she trailed by the same distance, so the second call time of 1:11 2/5 is increased to 1:11 4/5, resulting in an early pace time of 71 4/5. minus 46 or 25 4/5. "Now Pending" won the race, so the finish time need not be changed. The late pace time for the horse is 98 3/5 minus 71 4/5 or 26 4/5 seconds.

Figure 11:
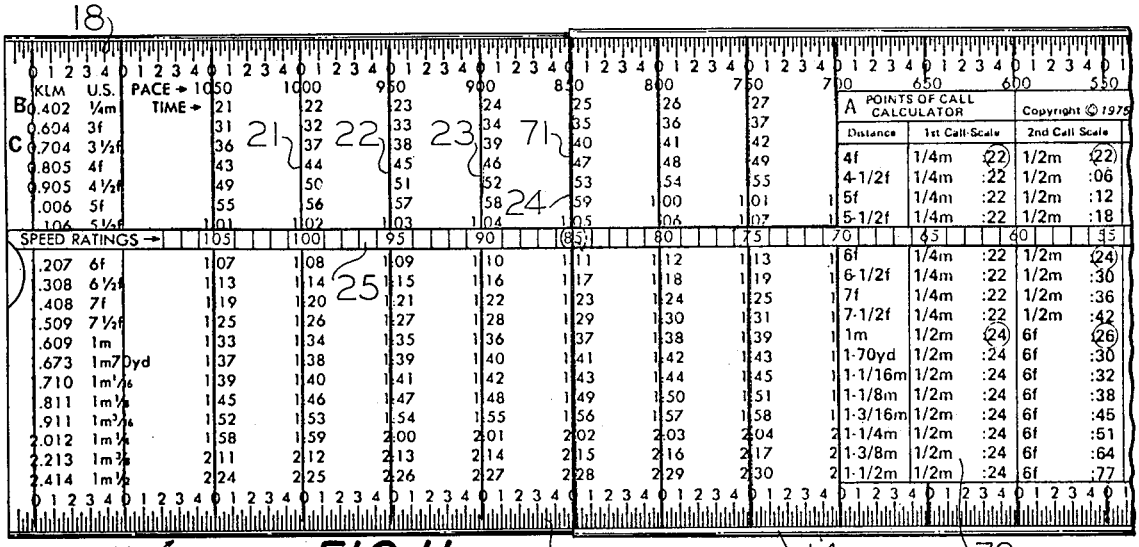
FIG. 11 is an elevational view of the calculator of the invention in neutral or beginning position.

The reference time in a mile race for the second call at six furlongs is 26 seconds in the 2nd Call Scale column. Reading to the right on table 70 indicates a closing time of 27 seconds earns a "good" rating on the average. This is one indicator for the handicapper. Comparison of the early and late pace times as gleaned from the past performance calls of each of the entered horses is another. Both of these comparisons are aided by the calculator of the invention which can perform the arithmetic above accurately and quickly as follows:

Align the three slides as shown in FIG. 11 with the transverse lines in coincidence, the left edge 71 of the outer slide 14 being aligned with transverse index line 24 passing through Speed Rating numeral 85. The slides 11 and 12′ are equal in length, preferably, and in this "neutral" position have right and left edges aligned. Note that the "Speed Rating" divisions are visible the length of slide 14 through it, and that Speed Rating index 85 aligns with Pace index 850.

Figure 12:
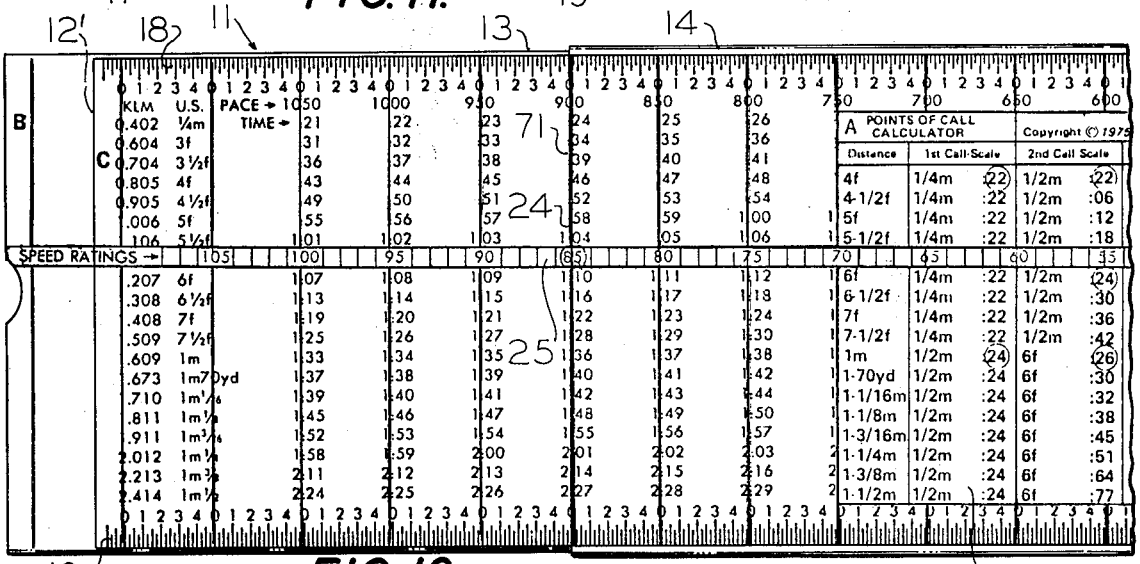
FIG. 12 is an elevational view of the calculator in a first calculating position.

The chart of FIG. 6 shows a first call time of 46 seconds in the mile race for "Now Pending":45 3/5 plus 1½ lengths back. Hold slides 14 and 13 fixed together and move slide 12′ until the time column headed ":24", which indicates a time of 46 seconds for the U.S. distance of 4 furlongs (½mile), aligns with lines 24 and 71 of slides 13 and 14, respectively, as shown in FIG. 12. Now fix slides 12′ and 13 together and move slide 14 to where its edge 24 indicates a 6 furlong time of 1:11 4/5, the corrected second call time for "Now Pending". This time is arrived at by scanning the time columns of slide 12′ horizontally from the leftward distance indication of 6 furlongs until the time 1:11 is found, and then adjusting for the fractional seconds by means of the divided 1/5 seconds on the upper and lower margins of composite slide 12′. The 1.5 ths are numbered from left to right in the illustrative embodiments, although the digits may be reversed in one marginal row if desired, say row 19, for instance.

The table 70 now is used, where the first call scale shows a scale value of :24 (circled) for a one mile race at the "first call"or ½ mile point. Assume Speed Rating index line 85 equals :24 (24 seconds). The edge 71 of slide 14 is to the left of Speed Rating line 85, indicating the time increment between line 85 and line 71 is to be added to the scale value :24. The increment, indicated by both rows 18 and 19, is 1 4/5 seconds, which added to 24 seconds equals 25 4/5 seconds. This is called the "early pace time".

The process is repeated for the race interval between the second call and the finish, and gives a "late pace time" of 26 4/5 seconds. Bear in mind that the second step requires setting the lines 24 and 71 at new values related to the times from the second call to the finish, and adopting the 2nd Call Scale time of :26 (circled) next to "6f" in that column for the scale value.

A handicapper would be wary of this filly, since the late pace time was a full second slower than the early pace time, and it developed that "Now Pending" finished ninth in the 1 1/16th mile race for which the foregoing data was published, after having been second at the 6 furlong point. However, for the mile race the late pace attained is still a "Good" performance.

Such adjective ratings are not definite, and the inventive calculator provides more exact means for comparative ratings of competing horses. The Speed Rating is one such means, although not the preferred one, since track records, the basis for the Rating, vary much from one part of the country to another, affected by class of horses, weather and track layout. The calculator can derive the Speed Rating from the time of a race if the track record is known, or, conversely, can show the track record if given the race time and the Speed Rating for the race. For instance, in FIG. 6 the finish time was 1:38 3/5 and the Speed Rating was "76". By aligning the slide 13 Speed Rating index "76" with a one mile columnar time of 1:38, plus 3/5 seconds displacement as indicated along marginal row 18, the track record 1:33 4/5 is indicated by the Speed Rating line "100" at 21, as it coincides with that time point on slide 12′.

More accurate than Speed Rating comparison and more easily discriminating between competitive horses than plain time figures is the use of a "High Pace Number". These Numbers are designated "PACE" on slide 12′ (FIG. 9) and extend horizontally just beneath marginal time row 18 and align transversely with the distance-time vertical columns of obverse laminate 54. The numbers decrease rightwardly by increments of 50 between values of 1050 and 400. The linear increment equals one second of time, and theoretically, represents 5 horse lengths, based upon the previously set forth assumption that 1/5 second equals one length in a race. Technically, then, each subdivision of the marginal time rows 18, 19 represents ¼length, since the space from 0 to 0 in those rows is divided in twentieths. The columnar times, then, increase one second between columns as the High Pace Number decreases 50 units.

Figure 13:
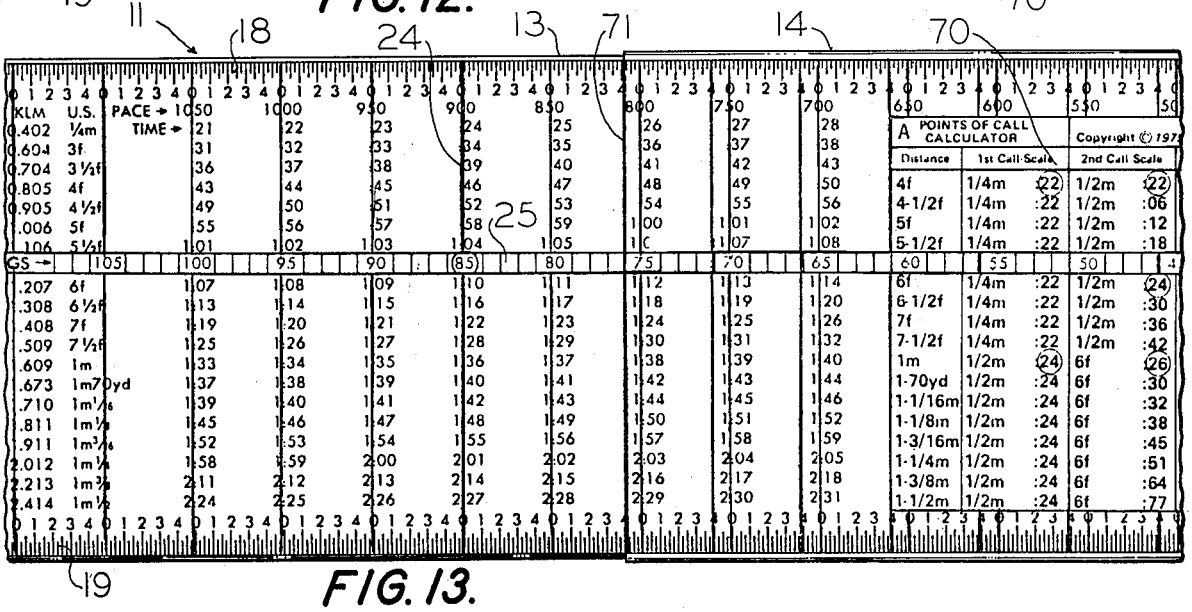
FIG. 13 is an elevational view of the calculator in a second calculating position.

Returning to the illustrations of FIGS. 12 and 13, the position of the slides in FIG. 13 indicates an early pace time of 25 4/5 seconds. By moving slide 14 with respect to slide 12′ until edge 71 aligns with 25 4/5, a High Pace Number of 810 is indicated. This number is recorded. The second step is then performed of calculating the late pace time, which in the previous example was shown to be 26 4/5 seconds, which when translated by the calculator to High Pace Number becomes 760. The total of 810 and 760 is 1570. When the performances of other competing horses are similarly calculated the higher order number of the High Pace Number provides finer comparison without resorting to awkward fractions or decimals. For instance, as indicated in the data charts of laminate 55 (FIG. 10), a change of post position from one race to another affects performance measurably. "Now Pending" went from post position 2 in the race of FIG. 6, line 1, to post position 11 in the prospective race. The total High Number would therefore be reduced by 35 in accordance with the circled Post Position Corrections data diagonally displayed on laminate 55, a change of 9 positions equalling a detriment of 3½ lengths or almost 4/5 seconds.

Similarly other variables displayed on laminate 55 may be applied to the PACE number or to the previously discussed pace times by use of the calculator to achieve more exacting comparisons between horses in a prospective race. Track condition data is displayed in area 81, in 1/5 seconds per unit distance. Time to be added for added distance is put forth in area 82 for both metric and English measure. Since the calculator of the invention reads from time to pace and from pace to time, corrections for variables may be made in either measure.

Corrections for weight, class and age variations are also set forth, any of which may be transferred to the time and rating slides to quickly and accurately modify ratings in accord with this refining data. Since the data of laminate 55 is visible by reversing tha calculator no loss or change of setting need take place in order to ascertain values needed to modify settings.

PROCEDURE

The High Pace Number is easily arrived at for each entrant in a race by the following process steps, which are in part repetitive of previous disclosure:

Start with the calculator in the neutral position of FIG. 11, with edges of slides 11 and 12′ aligned and slide 14 edge 71 on Speed Rating line "85" (24). Then move slide 12′ so that columnar time thereon equal to corrected First Call time of subject horse coincides with edges 24 and 71. Fix 12′ and 13 and set edge 71 of slide 14 at time on slide 12′ equal to Second Call corrected time for subject horse. Refer to 1st Call Scale and find scale value for distance of race and First Call increment. Assign that scale value to line 24 of slide 13, and add scale value and the difference in time as read on rows 18 or 19 between edges 24 and 71. Result is early pace time. Set edge 71 of slide 14 over time on slide 12′ equal to early pace time for distance increment and read on PACE index the High Pace Number, record the number.

Repeat all steps for the data given in the Past Performance Chart for the race increment between Second Call and race finish, remembering to use reference scale time of 2nd Call Scale, and add resulting Late High Pace Number to previously recorded Pace Number. Modify resultant sum with data from laminate 55 by moving slide 14 edge 71 with respect to time or averaged High Pace Number. It is important to note for reference that the High Pace Number divided by 20 will approximate the Speed Rating number.

Slide 13 has the designations "ADD" and "SUB" in the Speed Rating strip 25 to guide the user in determining whether to increase or decrease the reference scale time from table 70 by the amount of the time difference indicated by non-coinciding edges 24 and 71. If edge 71 is to the right of line 24, add the difference; if to the left of line 24, subtract the difference to obtain the pace time for the particular race increment.

As previously stated, it is the parts of the race between the First Call and the Second Call and the following part of the race between the Second Call and the finish which indicate the quality and fitness of the horses. The calculator of the invention enables a skilled handicapper to utilize that information accurately and quickly, when compared to conventional methods and devices, to concisely differentiate between those horses entered who have winning potential and those which do not. The data of laminate 55 refine the sums of the calculator for precise discrimination between top contenders. The data is in terms compatible with the indices of scales on slides 12, 13 and 14.

While this disclosure shows and describes a plurality of embodiments of the invention, these do not exhaust the potential of the invention. Other variations within the scope of the invention will occur to those skilled in the art. Therefore, it is desired that the invention be measured by the attached claims.

I claim:

1. A calculator for use in evaluating time and distance information and comprising a composite slide, obverse and reverse faces on the composite slide, a longitudinal time scale on the obverse face of the composite slide, a performing rating index on the composite slide increasing numerically oppositely to the time scale, an inner slide movable longitudinally with respect to the composite slide, a performance rating scale extending longitudinally of the inner slide and increasing numerically oppositely to the time scale, transverse index lines on the inner slide; an outer slide movable longitudinally with respect to the composite and inner slide each of said inner and outer slides being light transmitting such that data and indices from one slide are visible through an overlapping slide; performance rating tables on the outer slide, transverse index lines on the outer slide, and transverse time and distance columns on the obverse face of the composite slide, said time columns increasing in magnitude in accordance with distance increase and increasing by columns longitudinally oppositely to the increase of the performance ratings on the composite slide and the inner slide.

2. A calculator in accordance with claim 1 further comprising a reverse slide face, data visible on the slide face, said data being expressed in terms arithmetically summable on the other slides.

3. A calculator in accordance with claim 1 wherein the performance rating index on the composite slide is a decade multiple of the performance rating scale on the inner slide.

4. A calculator in accordance with claim 3 wherein index line longitudinal spacing on all slides is equivalent to the spacing of the time in seconds on the composite slide.

5. A calculator in accordance with claim 1 wherein the performance rating tables on the outer slide are in terms of times for various portions of complete race distances.

6. A calculator in accordance with claim 1 further comprising data on the reverse face of the composite slide expressed in terms arithmetically summable on the other slides.

* * * * *

UNITED STATES PATENT OFFICE

CERTIFICATE OF CORRECTION

PATENT NO. : 3,999,041

DATED : December 21, 1976

INVENTOR(S) : Joseph Scofield

It is certified that error appears in the above-identified patent and that said Letters Patent are hereby corrected as shown below:

Col. I line 55, change "tubu-" to --tabu- --;

line 56, change "date" to --data--.

line 61, change "a" to --an--;

Col. 2, line 21, change "not" to --hot--;

Col. 6, line 19, change "1.5ths" to --1/5ths--.

Col. 8, Claim 1, line 58, after "slide" insert --,--.

Signed and Sealed this

Fifth Day of April 1977

[SEAL]

*Attest:*

RUTH C. MASON
*Attesting Officer*

C. MARSHALL DANN
*Commissioner of Patents and Trademarks*